US008443593B2

(12) United States Patent
Sloss et al.

(10) Patent No.: US 8,443,593 B2
(45) Date of Patent: May 21, 2013

(54) LIQUID-COOLED EXHAUST VALVE ASSEMBLY

(75) Inventors: Clayton A Sloss, Paris (CA); Scott O. Nelson, Callander (CA)

(73) Assignee: Westcast Industries, Inc., Brantford, ON (CA)

( * ) Notice: Subject to any disclaimer, the term of this patent is extended or adjusted under 35 U.S.C. 154(b) by 464 days.

(21) Appl. No.: 12/636,123

(22) Filed: Dec. 11, 2009

(65) Prior Publication Data

US 2010/0146954 A1 Jun. 17, 2010

Related U.S. Application Data

(60) Provisional application No. 61/121,936, filed on Dec. 12, 2008.

(51) Int. Cl.
*F01N 5/02* (2006.01)

(52) U.S. Cl.
USPC ..... 60/320; 60/274; 60/324; 165/41; 137/625.41

(58) Field of Classification Search ..... 137/625.29, 137/625.31, 331, 339, 340, 564, 625.15, 137/625.17, 625.25, 625.68, 625.41, 310
See application file for complete search history.

(56) References Cited

U.S. PATENT DOCUMENTS 2,529,915 A * 11/1950 Chausson ..... 237/12.3 A
3,050,935 A 8/1962 Eastwood
3,570,590 A 3/1971 Kofink
3,831,622 A * 8/1974 Grewer et al. ..... 137/340
3,939,813 A 2/1976 Harrow et al.
4,371,027 A * 2/1983 Jacobsen ..... 165/297
4,380,246 A * 4/1983 Casale et al. ..... 137/375
4,593,749 A 6/1986 Schatz
4,630,445 A * 12/1986 Parker ..... 60/602

(Continued)

FOREIGN PATENT DOCUMENTS

EP 0913561 A2 5/1999
EP 1291509 A2 12/2003

(Continued)

OTHER PUBLICATIONS

International Search Report and Written Opinion of the International Searching Authority for Int. App. No. PCT/IB2009/007752, dated May 26, 2010.

(Continued)

*Primary Examiner* — Thomas Denion
*Assistant Examiner* — Jesse Bogue
(74) *Attorney, Agent, or Firm* — Harness, Dickey & Pierce, PLC

(57) ABSTRACT

A valve assembly may include a valve body, a valve member, and a valve shaft. The valve body may include an inlet, an outlet, and first and second fluid paths in fluid communication with the inlet. The first fluid path may extend axially through at least a portion of the valve body. The second fluid path may be defined by first and second annular walls and may at least partially surround the first fluid path. The valve member is disposed in the valve body and may be movable between a first position preventing fluid flow through the first fluid path and a second position allowing fluid flow through the first fluid path. The valve shaft may be fixed to the valve member and mounted to the valve body for rotation relative to the valve body.

20 Claims, 6 Drawing Sheets

U.S. PATENT DOCUMENTS

| | | | | |
|---|---|---|---|---|
| 5,033,264 | A * | 7/1991 | Cabral | 60/274 |
| 5,184,462 | A * | 2/1993 | Schatz | 60/274 |
| 5,193,582 | A * | 3/1993 | Antoniello et al. | 137/625.14 |
| 5,345,762 | A * | 9/1994 | Lutze | 60/288 |
| 5,499,501 | A * | 3/1996 | Kato et al. | 60/286 |
| 5,971,010 | A * | 10/1999 | Kallberg et al. | 137/340 |
| 6,141,961 | A | 11/2000 | Rinckel | |
| 6,327,852 | B1 * | 12/2001 | Hirose | 60/297 |
| 6,702,190 | B1 * | 3/2004 | Nohl et al. | 237/12.3 C |
| 6,758,038 | B2 * | 7/2004 | Ueno et al. | 60/297 |
| 6,942,027 | B2 | 9/2005 | Klotten et al. | |
| 6,955,213 | B2 | 10/2005 | Stonehouse et al. | |
| 7,032,577 | B2 * | 4/2006 | Rosin et al. | 123/568.12 |
| 7,036,565 | B2 * | 5/2006 | Brost et al. | 165/103 |
| 7,056,173 | B1 | 6/2006 | Shull et al. | |
| 7,077,114 | B2 | 7/2006 | Husges | |
| 7,168,419 | B2 | 1/2007 | Rosin et al. | |
| 7,255,096 | B2 * | 8/2007 | Craig et al. | 123/568.12 |
| 7,341,699 | B2 * | 3/2008 | Thieman et al. | 422/177 |
| 7,444,803 | B2 * | 11/2008 | Iwamoto et al. | 60/288 |
| 7,581,533 | B1 | 9/2009 | Moran | |
| 7,743,816 | B2 | 6/2010 | Mercz et al. | |
| 7,823,798 | B2 | 11/2010 | LeLieve | |
| 7,836,945 | B2 | 11/2010 | Speer | |
| 7,987,935 | B2 * | 8/2011 | Ichimoto | 180/65.28 |
| 2004/0182440 | A1 | 9/2004 | Watts et al. | |
| 2005/0133202 | A1 * | 6/2005 | Jorgensen et al. | 165/103 |
| 2005/0199381 | A1 | 9/2005 | Mercz et al. | |
| 2006/0288694 | A1 * | 12/2006 | Hayashi | 60/298 |
| 2008/0115487 | A1 | 5/2008 | Harada et al. | |
| 2008/0236913 | A1 | 10/2008 | Ichimoto | |
| 2009/0038302 | A1 | 2/2009 | Yamada et al. | |
| 2009/0049832 | A1 | 2/2009 | Hase | |
| 2009/0056909 | A1 | 3/2009 | Braun | |
| 2010/0089043 | A1 | 4/2010 | Dittmann et al. | |
| 2010/0146954 | A1 | 6/2010 | Sloss et al. | |

FOREIGN PATENT DOCUMENTS

| | | | |
|---|---|---|---|
| EP | 1431527 | A1 | 6/2004 |
| EP | 1475532 | A2 | 11/2004 |
| EP | 1739298 | A2 | 1/2007 |
| FR | 2859239 | A1 | 3/2005 |
| GB | 192489 | | 2/1923 |
| GB | 1300948 | | 12/1972 |
| GB | 1473153 | A | 5/1977 |
| GB | 2420593 | | 5/2006 |
| GB | 2441588 | A | 12/2008 |
| JP | 7-269332 | | 10/1995 |
| WO | 00/28203 | A1 | 5/2000 |
| WO | 01/50047 | A1 | 7/2001 |
| WO | 03/001114 | A1 | 1/2003 |

OTHER PUBLICATIONS

Extended European Search Report regarding Application No. 09830540.1, dated Nov. 27, 2012.

* cited by examiner 37
33
34a
36
34
38
31
30
35
33a
39
32

LIQUID-COOLED EXHAUST VALVE ASSEMBLY

CROSS-REFERENCE TO RELATED APPLICATION

This application claims the benefit of U.S. Provisional Application No. 61/121,936, filed on Dec. 12, 2008. The entire disclosure of the above application is incorporated herein by reference.

FIELD

The present disclosure relates to exhaust components employing valves to regulate exhaust flows. While the following examples and discussion generally relate to exhaust gas heat recovery applications, it should be understood by those skilled in the art that the general concepts discussed herein are also applicable to other "exhaust applications" such as thermal protection of exhaust components, or EGR (exhaust gas recirculation) systems, by way of non-limiting examples.

BACKGROUND

This section provides background information related to the present disclosure which is not necessarily prior art.

Automobile manufacturers and the entire transportation sector are facing an increasingly stringent set of governmental regulations. For example, mandates for ever lower pollutant emissions levels, as well as ever higher fuel efficiency requirements (now often expressed as ever lower carbon dioxide emissions levels) are constantly tightening. However, automobile systems which have been used successfully in the past are proving to be no longer adequate for automakers in this new environment. Therefore, to meet the new laws, mandates and requirements, automakers must adopt new technologies and systems and/or modify existing technologies and systems.

One of the automotive systems which affects both fuel economy and pollutant emissions levels is the exhaust system. Automotive engineers are discovering new ways for the exhaust system to help meet governmental mandates in these areas. For example, heat from the engine exhaust can be recovered and be used to warm the vehicle's working fluids (e.g. engine, transmission, and transaxle oil) under start-up and cold operating conditions to reduce friction, thus improving efficiency and increasing fuel economy. Improved warm-up of the engine coolant is also desirable for driver and passenger comfort because this can be used to warm up the vehicle cabin more rapidly and defrost the windshield in less time in cold start-up conditions. And because of new engine technologies, certain new exhaust components such as lean NOx traps are included in some exhaust systems to reduce smog generating nitrous oxides. These emissions components often require careful thermal regulation to maintain peak efficiency; otherwise large additions of expensive precious metals would be required to maintain conversion efficiency.

For these reasons and more, automakers are considering the addition of non-standard exhaust system components to their vehicles to achieve their goals. Specifically, controlling the flow and routing of exhaust gases to achieve thermal goals is becoming a new requirement. Heat exchangers and exhaust valves to control the flow of gases in the exhaust system are enablers for new exhaust system designs. Heat exchangers in exhaust systems can also be used, for example, to recover heat which would otherwise be lost through the tailpipe, and used in other forms to boost the overall efficiency of the vehicle systems. An example of this would be the generation of steam from the waste exhaust gas energy, which is then used to generate electricity or converted into motive power for direct vehicle propulsion.

It is often the case that the function of the exhaust gas heat exchanger is not required for the entire time that the engine is running, and therefore may require a shutoff function; likewise, the level of heat exchange may need to be controlled to a certain level below 100% of function. In cases like these, some method of controlling exhaust flow through the heat exchanger may be required. An exhaust valve is a typical technology which is used to achieve this control, as it is usually not practical to control the flow of coolant through the heat exchanger when it forms part of the engine cooling system.

Many modern gasoline engines can achieve exhaust gas temperatures between 950° C. and 1050° C. Most of today's exhaust valve designs reflect the extreme thermal environment in which this component spends its service life. While there are many types of exhaust valves, expensive, temperature-resistant materials are invariably used, and designs can be relatively complex for manufacturing. Additionally, if the exhaust valve conducts high temperatures externally, the valve's actuator may require shielding or the use of more expensive, high temperature materials.

The present disclosure provides a low-cost exhaust valve that is actively cooled by a working fluid, which may be the same fluid that flows through an associated heat exchanger. The valve does not experience the temperatures typically endured by other exhaust valves, therefore allowing for cheaper component materials having less complicated and lighter weight designs.

SUMMARY

Exhaust systems may contain features or components which necessitate the regulation of exhaust flow through all or a portion of the exhaust system. The regulation of exhaust flow may include the re-routing of exhaust gases into a secondary path or exhaust channel, which may include a heat exchanger through which engine coolant or other heat transfer fluid passes. The routing of exhaust gas may be controlled in such a way that it is throttled or adjusted to a certain percentage of full flow and it may or may not involve a complete stoppage of flow through the first channel.

According to the present disclosure, an exhaust valve assembly may be used to achieve the regulation of exhaust flows, and this exhaust valve may be located before or after the aforementioned heat exchanger. The valve assembly may include a valve shaft, a valve body, and a diverter. The component that houses the shaft and diverter and through which coolant passes may be referred to as the valve body. According to the present disclosure, the passages in the valve body through which the engine coolant or other cooling fluid pass, either into or out of the heat exchanger, may be routed in close proximity to the valve shaft. This keeps the valve components relatively cool and allows for lower cost construction and more reliable operation of the valve assembly.

According to the present disclosure, the valve may be a butterfly type (proceeding in both directions from the shaft) or the valve may be "bimodal," that is, a "flap" type, proceeding from only one side of the shaft. The valve may be supported by bearing surfaces on both ends or may be cantilevered, that is, supported on only one end.

Additionally, the valve body may be shaped so as to create separate channels for the control and regulation of the exhaust flow. These channels may be: arranged independently beside each other; arranged with a shared wall to create bifurcated channels; or arranged with one channel inside the other.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
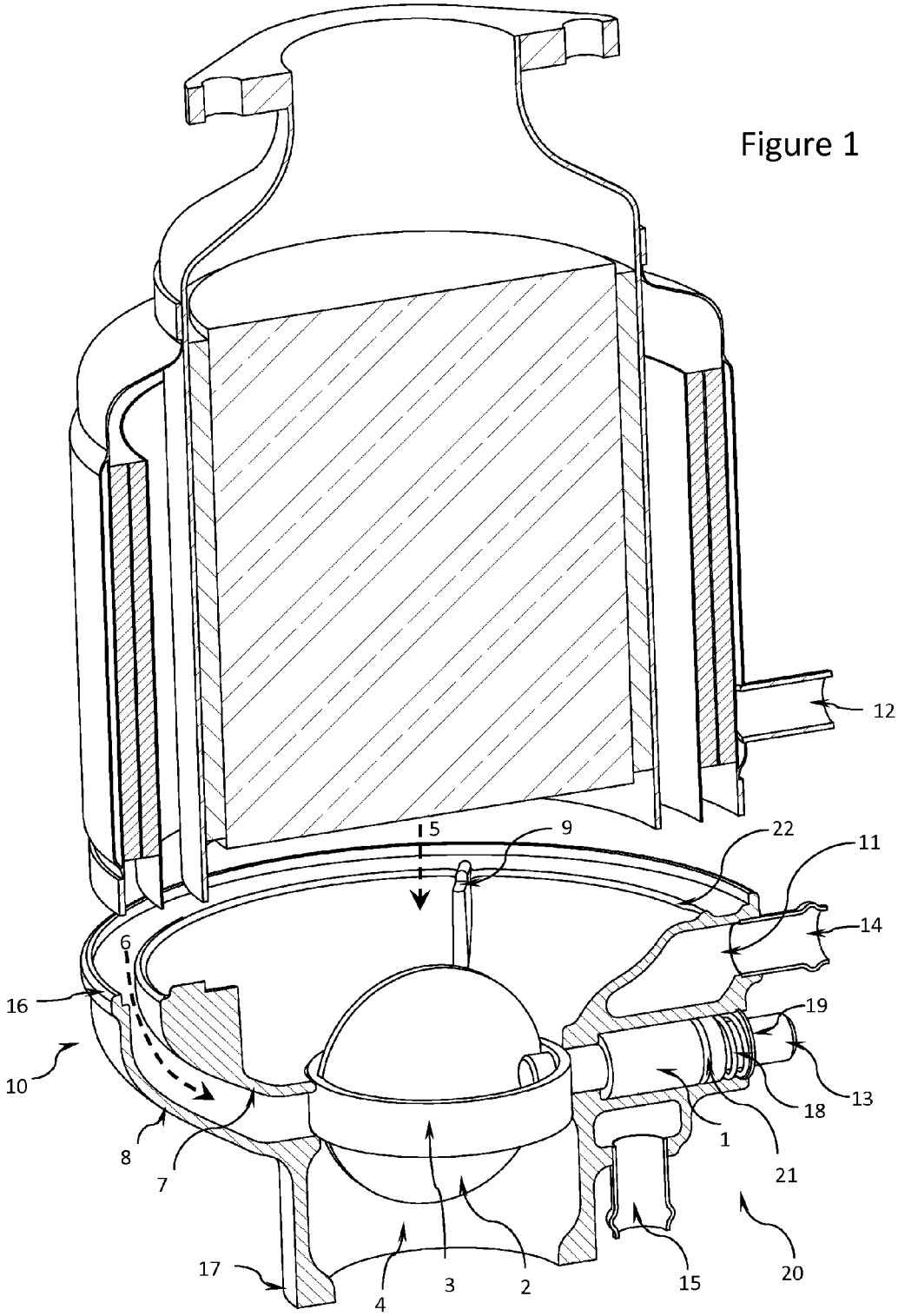
FIG. 1 is a break-away cross section view of an exhaust valve assembly in accordance with the teachings of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, and devices, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

FIG. 1 shows an exhaust valve assembly 20 that may include a valve body 10 housing a valve shaft 1 and a diverter 4. In this embodiment, the diverter 4 is an assembly of a butterfly-type diverter plate 2, and a ring shaped diverter 3. The valve body 10 is preferably, but not necessarily, manufactured by a casting process using a temperature-resistant material such as stainless steel. The valve body 10 has an outer wall 8 and an inner wall 7 that create two separate flow paths. A primary axial flow path 5 is centrally located within the valve body 10. A second flow path 6 is disposed in an annular fashion around the axial flow path 5. The exhaust valve assembly 20 allows for the selective regulation of exhaust gases through the primary and secondary flow paths 5, 6 by altering the position of the diverter 4 by controlling the angular position of the valve shaft 1.

Rotation of the valve shaft 1 is accomplished by the attachment of an actuator (not shown) to the end of the valve shaft in location 13. The valve plate 2 and diverter ring 3 may be manufactured from relatively thin (approximately 2-3 millimeters) heat resistant material. The material may depend on the application temperature. For example, austenitic stainless steel may be used for high temperature gasoline engines. The valve plate 2 may be cut or stamped from flat sheet and may or may not be round. The diverter 4 may be welded, brazed, pressed onto, or otherwise attached to the valve shaft 1. The valve shaft 1 may be formed from a high temperature stainless steel. Corresponding recesses in the valve plate 2, diverter ring 3, and valve shaft 1 allow the components to be reliably located and mated together.

The valve body 10 shown in FIG. 1 contains a coolant passage 11 which may be connected with the engine/vehicle cooling system. The coolant passage 11 is located in close proximity to the valve shaft 1, to keep the bearing surfaces of the valve shaft 1 and the valve body 10 within a relatively small temperature range. By isolating the bearing surfaces of the valve shaft 1 and valve body 10 from the large temperature excursions that would be otherwise encountered in a valve without cooling, the durability of these components is greatly enhanced and lower cost materials can be used. The cooling effect also helps to prevent spalling at the mating surfaces between the valve shaft 1 and the valve body 10. Contact between the main sealing surfaces of the valve shaft 1 and the valve body 10 may be maintained by a spring 18 which is held in place by a retainer 19. Additionally, an o-ring 21 on the valve shaft 1 prevents leakage of gases outside of the exhaust valve assembly 20. A coolant connection may be made with the heat exchanger through a coolant tube (not shown) between the valve body coolant outlet nipple 14 and the heat exchanger coolant inlet nipple 12. Similarly, coolant connections with the exterior coolant system are accomplished by hose connections at the valve body coolant inlet nipple 15 and the heat exchanger coolant outlet nipple (not shown). The coolant nipples 14 and 15 are generally brazed or welded into the valve body 10.

The valve body assembly 20 is assembled with the associated heat exchanger and/or emissions components, using the edge 16 of the outer wall 8 and the edge 22 of the inner wall 7. Additionally, components may be attached in the central flow path by means of a series of small stand-offs 9. The valve assembly 20 attaches to the overall exhaust system by means of a welded or bolt-together flange 17.

Figure 2:
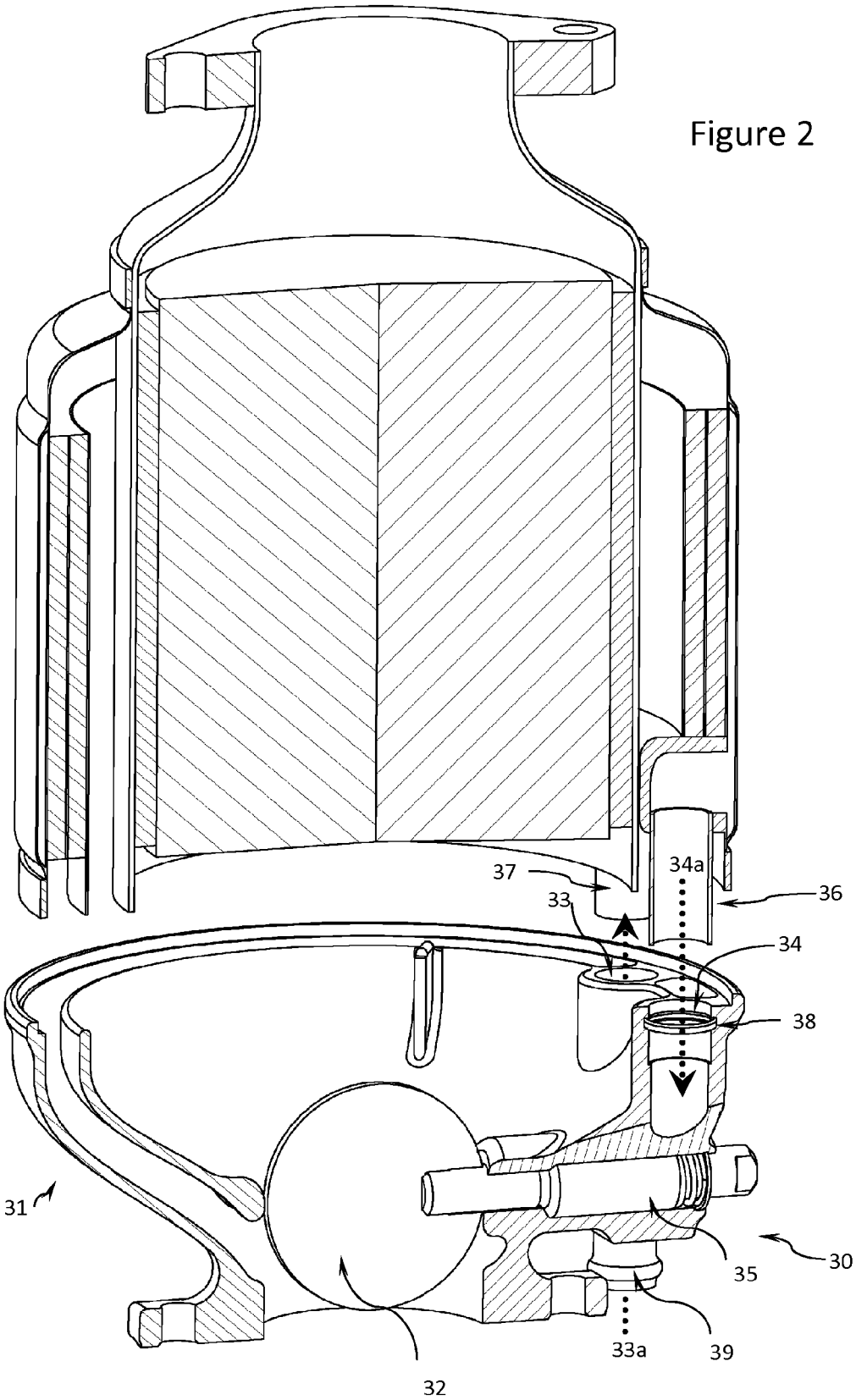
FIG. 2 is a break-away cross section view of a second embodiment of the diverter and valve body.

Referring now to FIG. 2, another embodiment of an exhaust valve assembly 30 is provided and may be similar to the exhaust valve assembly 20 described above with two major exceptions. The first is that the diverter is comprised of only the valve plate 32. The second major difference is that the valve body 31 contains two coolant passages 33 and 34 for coolant travelling to the heat exchanger (33*a*) and returning from the heat exchanger (34*a*). The coolant passages 33 and 34 are located in close proximity to the valve shaft 35, and may be located to keep the bearing surfaces of the valve shaft 35 and the valve body 31 at a relatively low temperature. Coolant connections with the heat exchanger are made by sliding the heat exchanger coolant tubes 36 and 37 into the coolant passages 33 and 34 and sealing them with an o-ring 38. Similarly, coolant connections with the exterior coolant system are accomplished by hose connections 39 that are usually brazed or welded into the valve body 31.

Figure 3B:
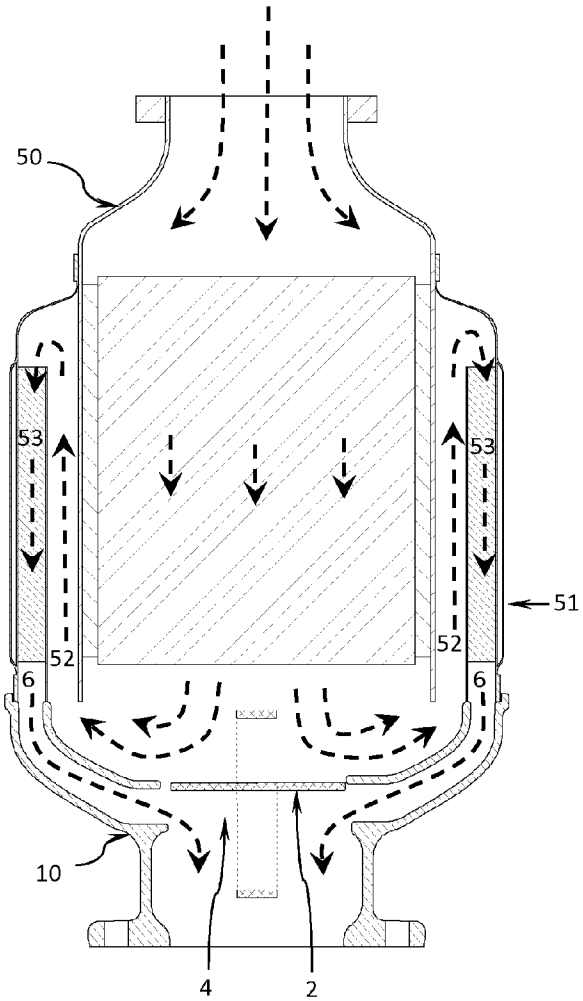
FIGS. 3*a* and 3*b* illustrate section views of the first embodiment of the exhaust valve assembly assembled with a heat exchanger downstream of an emissions component, showing the exhaust gas routing with the valve open (bypass mode) and closed (heat exchange mode)
Figure 3A:
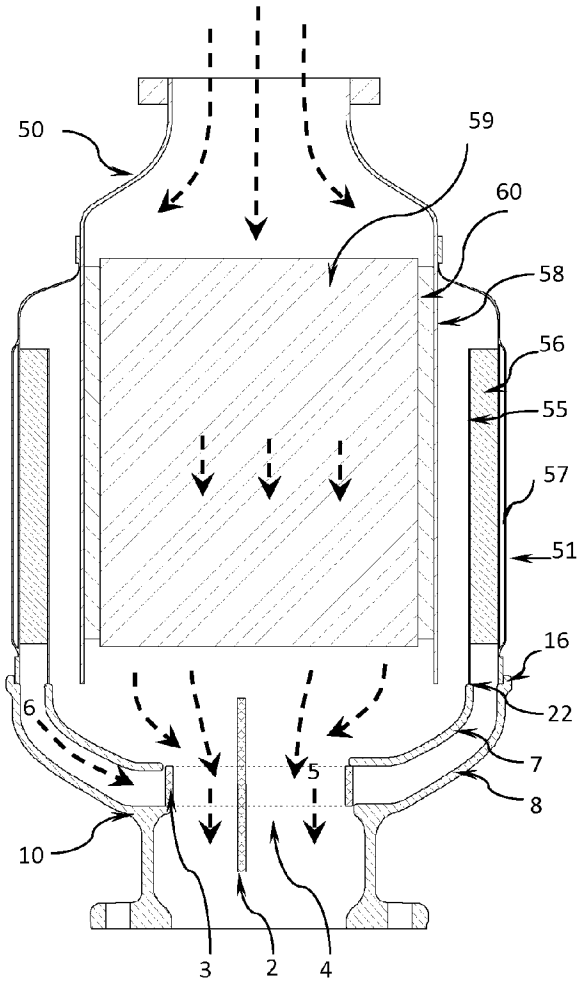

FIGS. 3*a* and 3*b* illustrate how the exhaust valve assembly 20, 30 can be integrated into an exhaust system sub-assembly. In this figure, the exhaust valve assembly 20 is located downstream of a standard three way automotive catalyst 50. In the heat exchanger bypass mode of FIG. 3*a*, the diverter 4 is in a first position that allows the exhaust gases to pass through the central flow path 5, along the valve plate 2. In this position the diverter ring 3 blocks off the secondary flow passage 6. When maximum heat extraction is desired, the diverter 4 is rotated 90 degrees into a second position (FIG. 3*b*) so that the valve plate 2 forces the exhaust gas to be routed in an annular manner through a heat exchanger 51 and finally out the secondary flow path 6 of the valve body 10. For intermediate levels of heat extraction, the diverter 4 may be positioned in an intermediate position between the first and second positions to regulate partial flow to each of the flow passages.

The heat exchanger 51 may include an inner flow path 52 and an outer flow path 53, which are separated by a dividing wall 55. A heat exchange element 56 is placed in the outer flow path 53 and may be surrounded by a coolant jacket 57. The inner flow path 52 may be left as an empty space to allow for variations in manufacturing and assembly, such as the variable diameter of a catalyst can 58 due to the need to calibrate the catalyst can 58 to account for variations in a catalyst substrate 59 and mat 60. In some embodiments, the flow path 52 may contain a heat exchange element to facilitate a desired thermal performance.

Figure 4B:
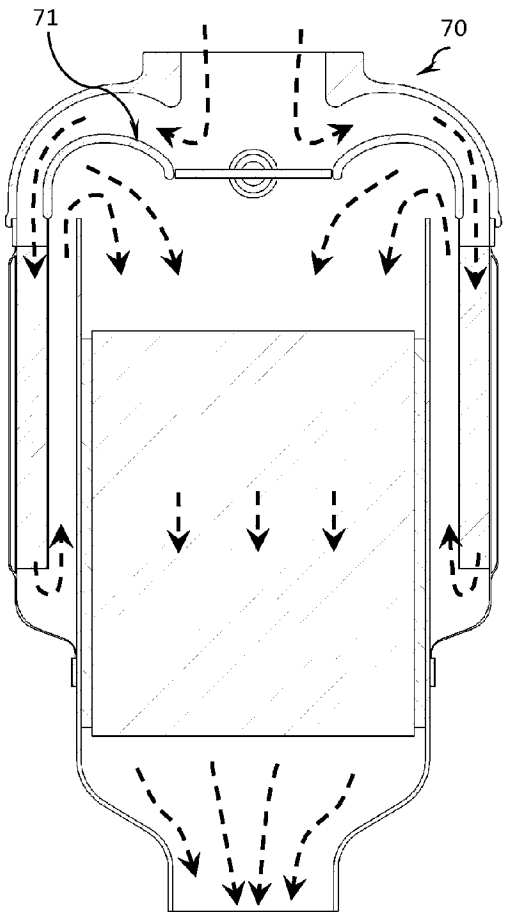
FIGS. 4*a* and 4*b* illustrate section views of the second embodiment of the exhaust valve assembly assembled with a heat exchanger upstream of an emissions component, showing the exhaust gas routing with the valve open (bypass mode) and closed (heat exchange mode)
Figure 4A:
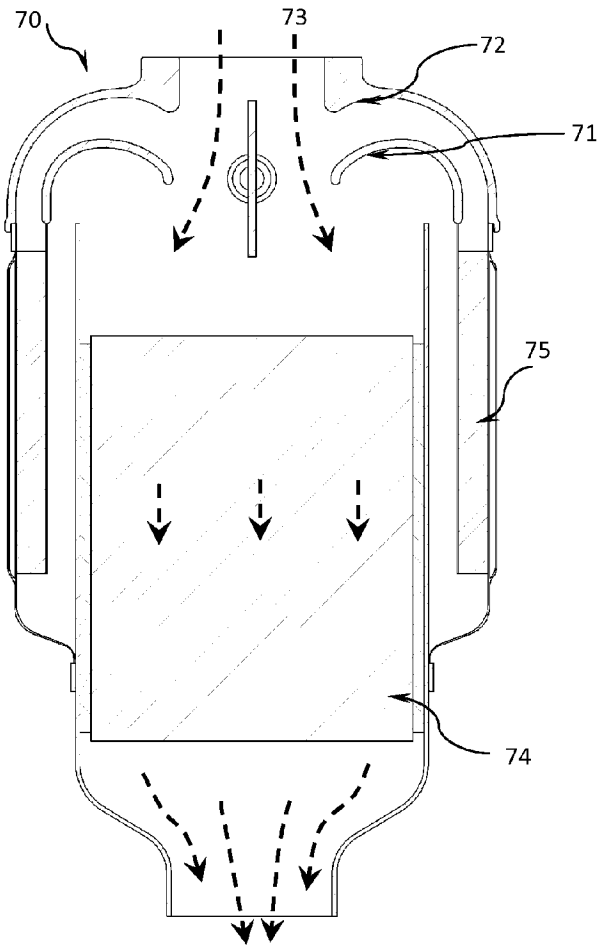

FIG. 4*a* shows an alternative embodiment for a valve body 70 shown in a position upstream of an emissions component 74 and/or heat exchanger 75. An inner valve body wall 71 and an outer valve body wall 72 may be shaped to aid in directing the exhaust gases through a central flow path 73 in a heat exchanger bypass mode (FIG. 4*a*). Similarly, in the full heat exchange mode of FIG. 4*b*, the inner wall 71 is shaped to aid the dispersion of the exhaust gases to achieve good flow uniformity for gases entering the emissions component 74 such as a catalytic converter.

Figure 5:
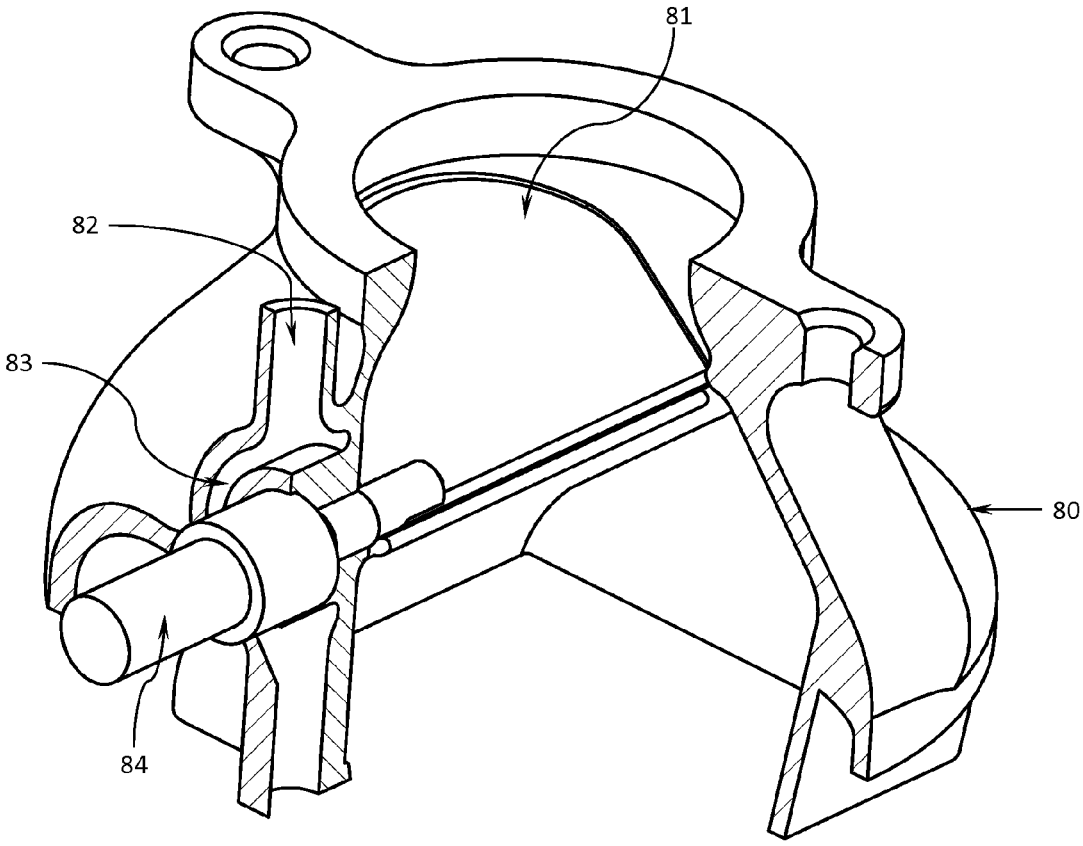
FIG. 5 is a section view in perspective of a third embodiment of an exhaust valve assembly.

An alternative valve body 80 and valve plate 81 arrangement is shown in FIG. 5. In this embodiment, the valve plate 81 is an unbalanced design that selectively closes off one of two flow paths and can be positioned in an intermediate position that will regulate partial flow to each of the flow paths. A coolant passage 82 connects to a water jacket 83 that surrounds and cools the valve shaft 84.

Figure 6A:
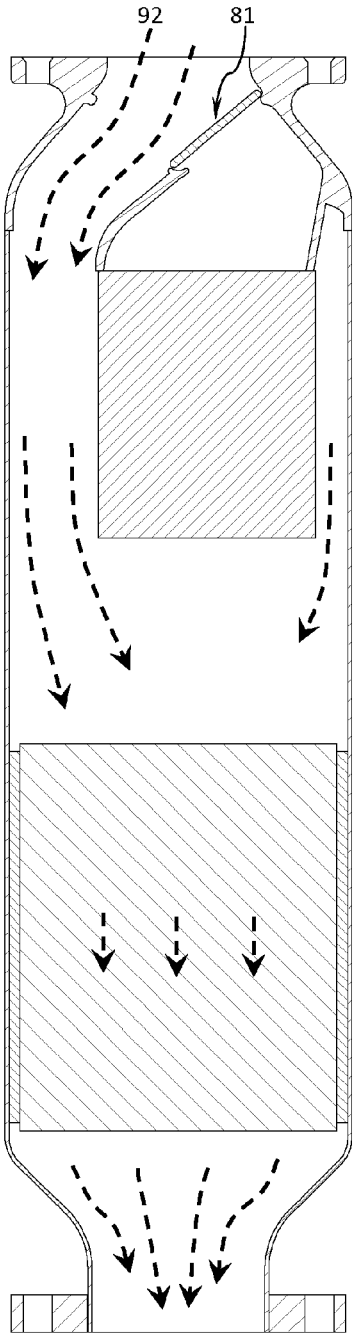
FIGS. 6*a* and 6*b* are sectional views showing the operation of the third exhaust valve embodiment.
Figure 6B:
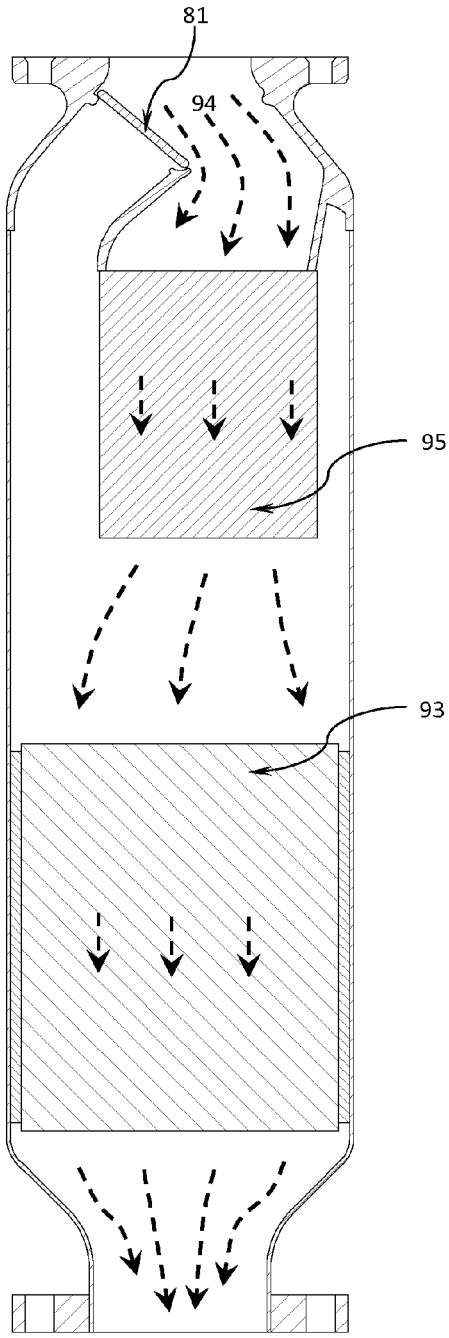

FIGS. 6*a* and 6*b* illustrate how the valve body 80 can be used in a larger assembly. When the valve plate 81 is in the heat exchanger bypass mode of FIG. 6*a*, the exhaust gas is directed through the primary flow path 92 to the emissions component 93 (e.g. catalytic converter substrate). When the emissions component needs thermal protection or thermal energy is desired to be extracted for other purposes, the valve plate 81 changes positions to allow some or all of the exhaust gases to pass through the secondary flow path 94 and into the heat exchanger 95, as shown in FIG. 6*b*, to cool the exhaust gases prior to entering the emissions component 93.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A valve assembly comprising:

a valve body including first and second inlets, an outlet, and first and second fluid paths in fluid communication with the outlet and the first and second inlets, respectively, the first fluid path extending axially through at least a portion of the valve body, and the second fluid path being defined by first and second annular walls and at least partially surrounding the first fluid path;

a valve member disposed in the valve body and movable between a first position restricting a fluid from flowing through the first fluid path and allowing the fluid to flow through the second fluid path and a second position allowing fluid through the first fluid path; and a valve shaft fixed to the valve member and mounted to the valve body for rotation relative to the valve body, wherein the valve member includes a diverter ring and a valve plate.

2. The valve assembly of claim 1, further comprising a coolant passage extending through at least a portion of the valve body, the coolant passage being disposed proximate to the valve shaft to facilitate heat transfer between the valve shaft and a coolant flowing through the coolant passage.

3. The valve assembly of claim 1, wherein the valve member is selectively movable into an intermediate position allowing fluid flow through the first and second fluid paths.

4. The valve assembly of claim 2, wherein the coolant passage at least partially surrounds an outer diameter of the valve shaft.

5. The valve assembly of claim 1, further comprising a plurality of coolant passages disposed in the valve body.

6. A vehicle exhaust system comprising:

a valve assembly including a valve body and an adjustable valve member, the valve body having a first exhaust gas flow path and a second exhaust gas flow path at least partially surrounding the first exhaust gas flow path, the adjustable valve member is selectively movable between a plurality of positions directing exhaust gas into at least one of the first and second exhaust gas flow paths;

an emissions component mounted to the valve body and in selective fluid communication with the first and second exhaust gas flow paths; and a heat exchanger in heat transfer relation with the second exhaust gas flow path, wherein fluid flow is allowed only through the first exhaust gas flow path when the valve member is in a bypass position and fluid flow is allowed only through the second exhaust gas flow path when the valve member is in a heat exchange position, wherein the second exhaust gas flow path includes a portion through which fluid flows only radially outward along a plane that is partially defined by a rotational axis of the valve member.

7. The vehicle exhaust system of claim 6, wherein the valve member is movable between the bypass position allowing fluid flow through the first exhaust gas flow path and the heat exchange position preventing fluid flow through the first exhaust gas flow path.

8. The vehicle exhaust system of claim 7, wherein the emissions component is in fluid communication with the heat exchanger when the valve member is in the heat exchange position.

9. The vehicle exhaust system of claim 6, wherein the first fluid path extends axially through at least a portion of the valve body, and the second fluid path is defined by first and second annular walls and at least partially surrounds the first fluid path.

10. The vehicle exhaust system of claim 6, further comprising a coolant jacket at least partially surrounding an outer flow path of the heat exchanger.

11. The vehicle exhaust system of claim 6, further comprising a valve shaft fixed to the valve member and mounted to the valve body for rotation relative to the valve body.

12. The vehicle exhaust system of claim 11, wherein the valve body includes at least one coolant passage disposed proximate the valve shaft to facilitate heat transfer between the valve shaft and a coolant flowing through the at least one coolant passage.

13. The vehicle exhaust system of claim 6, wherein the emissions component is disposed upstream of the valve body.

14. The vehicle exhaust system of claim 6, wherein the emissions component is disposed downstream of the valve body.

15. The vehicle exhaust system of claim 6, wherein the valve member includes a diverter ring and a valve plate.

16. The vehicle exhaust system of claim 6, wherein the heat exchanger at least partially surrounds the emissions component.

17. The vehicle exhaust system of claim 6, wherein the heat exchanger is disposed upstream of the emissions component.

18. A vehicle exhaust system comprising:

a body having an inlet;

a valve body attached to the body and including an outlet and first and second exhaust gas paths in fluid communication with the inlet of the body, the first fluid path extends axially through at least a portion of the valve body, and the second exhaust gas path is defined by first and second annular walls at least partially surrounding the first exhaust gas path;

a valve plate disposed in the valve body and movable between a bypass position allowing fluid flow through the first exhaust gas flow path and a heat exchange position preventing fluid flow through the first exhaust gas flow path;

a valve shaft fixed to the valve plate and mounted to the valve body for rotation relative to the valve body;

a coolant passage extending through at least a portion of the valve body, the coolant passage being disposed proximate to the valve shaft to facilitate heat transfer between the valve shaft and a coolant flowing through the coolant passage;

a catalytic converter disposed in the body and in fluid communication with the inlet and the outlet; and wherein the body includes a heat exchanger in fluid communication with the second exhaust gas flow path and catalytic converter when the valve plate is in the heat exchange position, wherein fluid flow is allowed only through the first exhaust gas flow path when the valve plate is in the bypass position and fluid flow is allowed only through the second exhaust gas flow path when the valve plate is in the heat exchange position, wherein the second exhaust gas flow path includes a portion through which fluid flows only radially outward along a plane that is partially defined by a rotational axis of the valve shaft.

19. The vehicle exhaust system of claim 18, wherein the coolant passage includes a coolant jacket at least partially surrounding the valve shaft, the coolant passage being in fluid communication with a conduit extending from the heat exchanger.

20. The vehicle exhaust system of claim 18, wherein the valve plate is coupled with a diverter ring and movable therewith to block the first exhaust gas flow path in the bypass position.

* * * * *

UNITED STATES PATENT AND TRADEMARK OFFICE

CERTIFICATE OF CORRECTION

PATENT NO. : 8,443,593 B2
APPLICATION NO. : 12/636123
DATED : May 21, 2013
INVENTOR(S) : Sloss et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 511 days.

Signed and Sealed this
Second Day of December, 2014

Michelle K. Lee

Michelle K. Lee
*Deputy Director of the United States Patent and Trademark Office*